United States Patent [19]

Smetana et al.

[11] 4,418,973

[45] Dec. 6, 1983

[54] WEDGE BASE LAMP SOCKET ASSEMBLY

[75] Inventors: Andrew Smetana, Mentor; James M. Hanson, Euclid, both of Ohio

[73] Assignee: General Electric Company, Schenectady, N.Y.

[21] Appl. No.: 299,388

[22] Filed: Sep. 4, 1981

[51] Int. Cl.[3] ..... H01R 13/74

[52] U.S. Cl. ..... 339/31 L; 339/97 L; 339/128; 339/176 L

[58] Field of Search ..... 339/59 L, 97 L, 128, 339/119 L, 125 L, 176 L, 184 L, 191 L, 195 L, 222, 31 L

[56] References Cited

U.S. PATENT DOCUMENTS

| | | | |
|---|---|---|---|
| 1,200,825 | 10/1916 | Fenety | 339/97 L |
| 2,646,554 | 7/1953 | Pollock | 339/97 L |
| 3,366,911 | 1/1968 | Wilson et al. | 338/197 |
| 3,404,268 | 10/1968 | Fowler | 240/10 |
| 3,535,672 | 10/1970 | Magi | 339/59 L |
| 3,775,731 | 11/1973 | Merki et al. | 339/128 |
| 3,945,707 | 3/1976 | Fitzgerald | 339/128 |

FOREIGN PATENT DOCUMENTS

| | | | |
|---|---|---|---|
| 2115713 | 12/1978 | Fed. Rep. of Germany | 339/176 L |
| 1386520 | 3/1975 | United Kingdom | 339/176 L |

*Primary Examiner*—John McQuade

*Attorney, Agent, or Firm*—John F. McDevitt; Philip L. Schlamp; Fred Jacob

[57] ABSTRACT

An improved socket member for a wedge base type incandescent lamp is disclosed which includes resilient engagement means to mount the lamp and socket assembly for subsequent operation along with particular electrical termination means being provided in the lamp socket member to help facilitate automatic installation of the lamp and socket assembly. The preferred termination means further include insulation piercing elements to physically grip the insulated electrical conductors associated with said lamp assembly during final installation of the lamp and socket assembly.

3 Claims, 3 Drawing Figures

Fig. 1
PRIOR ART
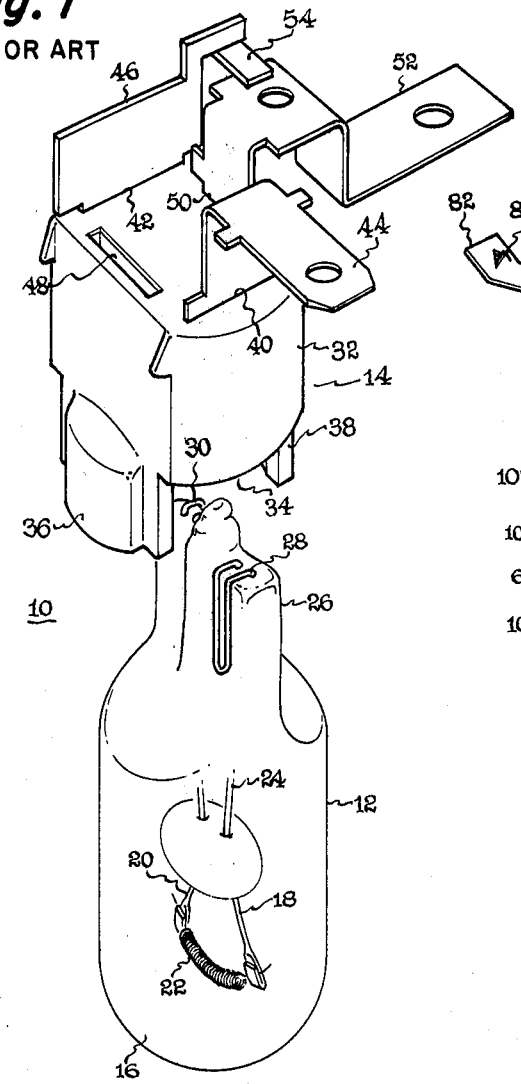
Fig. 2
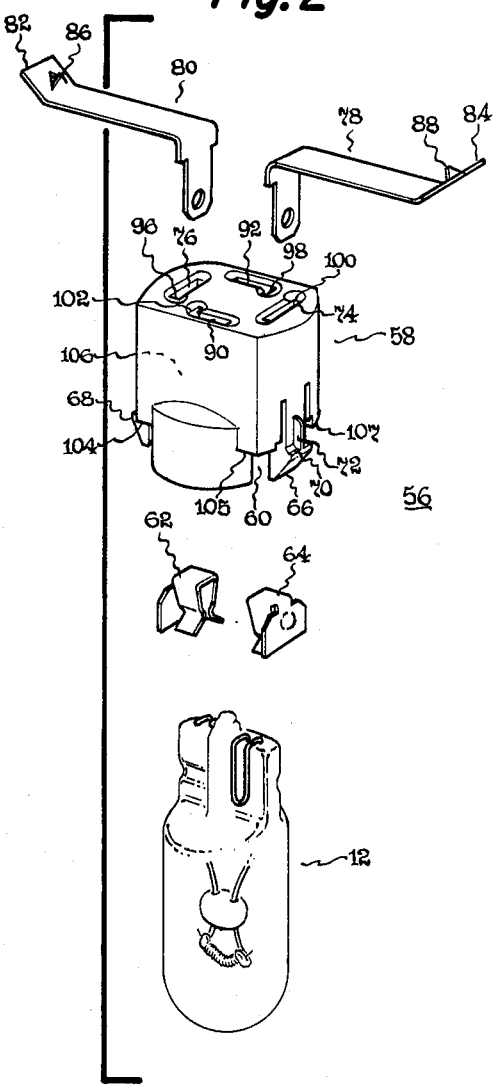
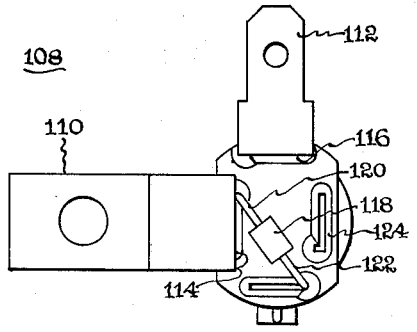
Fig. 3

WEDGE BASE LAMP SOCKET ASSEMBLY

BACKGROUND OF THE INVENTION

The wedge base type incandescent lamp has been in use for some time in various product applications including instrument panels for automotive and other type vehicles. An insulated socket member that is generally formed of a synthetic organic polymer material and which contains a pair of connector elements serves as the means for electrical termination of this type lamp. It is known to include slot openings in the base of said insulated socket member for insertion of electrically conductive metal terminals in the form of metal strips which electrically contact a pair of connector elements located inside of the plastic socket member. It would be desirable to modify the structure of this socket member for automatic high speed manufacture as well as subsequent installation of the lamp and socket subassembly into the final product, such as in automotive instrument panels.

Various entertainment devices such as pinball machines include miniature incandescent lamps to provide an illuminated display when the device is operated. A plywood panel is now employed in pinball machines to serve as an installation panel for these lamps with the socket member terminals simply being mechanically stapled to the plywood by hand labor which is also used extensively in other assembly tasks needed to complete electrical termination of these lamps on the plywood panel. Assembly of the aforementioned prior art socket member first press fits the metal strip terminals into the slot openings, then solders or welds external electrical elements on the assembled terminals, next inserts and mechanically staples the socket member into the plywood panel openings, and finally solders electrical conductors to the assembled terminals. The hand labor used in this type assembly is understandably extensive especially since existing socket designs do not include features which physically hold the parts being assembled in a fixed location or accommodate tolerance variation between parts. An improved socket construction including such features would further lessen hand labor in the overall assembly process for attendant lower costs as well as higher quality and greater reliability in the final product.

SUMMARY OF THE INVENTION

It has now been discovered that all of the foregoing objectives can be provided with an improved socket member construction which includes resilient engagement means to physically grip the socket member into the installation panel while further modifying the slot openings of the socket member to accommodate other external electrical elements that cooperate with the lamp assembly when operated. More specifically, the present lamp socket comprises a cylindrical shaped plastic member with a hollow cavity opening at one end into which the lamp is inserted for frictional engagement with a pair of connector elements located at the bottom of said hollow cavity, slots located at the other end of said plastic body member which communicate with the connector elements, and electrically conductive metal terminals which are pressed into the slots for electrical contact with said connector element, wherein the improvements comprise further including resilient engagement means at the open end of the plastic body member and shaping the slots to accommodate other external electrical elements being pressed into said slot for electrical contact with the connector elements. To still further facilitate assembly of the socket and lamp subassembly to the plywood or other type installation panel to which the assembled lamps are electrically wired, the present socket member can include additional features. Accordingly, the electrically conductive metal terminals which are pressed into said socket member can further include insulation piercing elements which physically grip the insulated electrical wires being connected to the lamp during the assembly process and with the electrical termination being completed simply by the piercing action of these elements. An assembly process utilizing the present socket members can thereby eliminate all soldering steps now being used for final installation.

In a preferred embodiment for faster assembly of the wedge base lamp to the plywood installation panel now being used in pinball machines, the improved lamp socket comprises a cylindrical shaped plastic body member with a hollow cavity opening at one end into which the lamp is inserted for frictional engagement with a pair of connector elements located at the bottom of said hollow cavity, a first and second pair of slots located in opposing relationship at the other end of said plastic body member, only said first pair of slots communicating with said connector elements but with said second pair of slots being electrically connected to said connector elements by external electrical elements, and electrically conductive metal terminals which are pressed into the slots for electrical contact with said connector elements, wherein the improvements comprise a pair of opposing resilient fingers being integrally formed in the open end of the plastic body member to physically engage a circular opening in the plywood panel together with forming larger size openings at one end of each slot to accommodate other external electrical elements being pressed into said slots for electrical contact with said connector elements. The larger size openings in the slots of said preferred embodiment can further be tapered to facilitate entry therein of the external electrical elements being connected to the lamp assembly with automatic manufacturing equipment. The external electrical elements which can be automatically connected in this manner to said preferred socket embodiment include a jumper wire or a semiconductor diode and both will be series connected with the lamp in the electrical circuit. An additional structural feature is also provided in the resilient finger elements of said preferred socket embodiment to retain the desired gripping action when the socket members are pressed into the opening of a conventional plywood installation panel having customary thickness variations. More particularly, a protruding longitundinally extending rib is provided on each of said resilient finger elements to insure a physical gripping action between the socket and the plywood panel opening despite thickness variation of said panel or tolerance variation in the circular opening. Insertion of said socket embodiment into the opening of the plywood installation panel thereby further eliminates any additional alignment or stapling to complete the final assembly therebetween. Additionally, the contour of the preferred socket member further includes four planar sections providing physical support and positioning necessary for accurate placement of all parts during the final assembly process.

BRIEF DESCRIPTION OF THE DRAWINGS

FIG. 1 depicts in cross-section one type prior art wedge base lamp socket assembly.

FIG. 2 illustrates a substitute socket member for the wedge base lamp in FIG. 1 which is made in accordance of the present invention.

FIG. 3 depicts a different socket member of the present invention utilizing one type cooperative external electrical element.

DETAILED DESCRIPTION OF THE PRESENT INVENTION

Referring to FIG. 1, there is shown in cross-section a conventional wedge lamp and socket member subassembly 10 having a wedge base incandescent lamp 12 which is inserted into a socket member 14 that provides the electrical termination means for said lamp. The lamp 12 comprises a transparent glass envelope 16 which contains a pair of inleads 18 and 20 connected to a resistive incandescent filament 22 and physically supported on a glass mount construction 24 for hermetic sealing at the pressed seal region 26 permitting egress of said inleads at locations 28 and 30 to an external electrical power source. The socket member 14 includes a cylindrical shaped plastic body member 32 with a hollow cavity 34 at one end into which the lamp is inserted for frictional engagement with a pair of connector elements (not shown) located at the bottom of said hollow cavity. At the open end of said cavity there is further provided a pair of longitudinally extending ear elements 36 and 38 which physically support the lamp when inserted into the socket member. At the other end of said plastic body member 32 there is provided a first pair of slot openings 40 and 42 which communicate with the internal connector elements and into which are press fit electrically conductive metal terminals 44 and 46 for electrical contact with the lamp inleads. A second pair of slot openings 48 and 50 are located in opposing relationship to the first pair of slot openings 40 and 42 and do not physically communicate with the internal connector elements of the socket member. Electrical contact is made to one of said connector elements, however, by means of inserting another electrically conductive metal terminal 52 into slot opening 50 and soldering or welding a conductive metal strip 54 between said terminal 52 and metal terminal 46 which is in physical contact with said connector element. The interconnection of the electrically conductive terminals in this manner provides a means to locate the terminals in any pair of the slot openings for a more flexible spatial orientation of the electrical termination for said lamp.

FIG. 2 is another exploded view depicting the essential structure features for the improved socket member of the present invention. Specifically, said improved lamp and socket subassembly 56 includes the previously described lamp member 12 which is inserted into said modified cylindrical shape plastic body member 58 having a hollow cavity opening 60 at one end containing a pair of connector elements 62 and 64 located at the bottom of said hollow cavity and which further includes a pair of resilient finger elements 66 and 68 integrally formed in the plastic body member at its open end. Said resilient finger elements provide the engagement means which grip the plastic socket member in place when pressed into the opening of the installation panel (not shown) to prevent both disengagement from the panel as well as rotation in the opening. More particularly, a relief portion 70 on the contour of each resilient finger provides positive locking relationship with the installation panel, whereas a longitudinally extending rib 72 on said contour resists rotation of the socket member after insertion into the panel opening while maintaining physical contact in said opening despite variations in the thickness of the panel. At the opposite end of said plastic body member 58 there is provided a first pair of slots 74 and 76 communicating with said connector elements 62 and 64 and into which there is press fit a pair of electrically conductive metal terminals 78 and 80. As can be noted, said metal terminals physically contact the connector elements after insertion into the slots and with the other end of said terminal elements being in physical contact with the installation panel when the socket member has been assembled thereto. It can be further noted from the drawing that said latter ends 82 and 84 of the terminal elements further include bends which permit assembly of electrical wires in the lamp circuit to the terminals by a simple mechanical crimping operation wherein piercing elements 86 and 88 make the electrical connection to the wires. A second pair of slot openings 90 and 92 located in opposing relationship to the first pair of slot openings in said modified socket member, do not physically communicate with the internal connector elements. Electrical contact of slot openings 90 and 92 with said internal connector elements occurs only by external connection means wherein an electrical element is pressed into one of said openings while also being pressed into one of the slot openings 74 and 76. Accordingly, all four slot openings further include larger size openings 96, 98, 100, and 102 to accommodate said external elements which provide electrical contact with the interior connector elements. By arranging for a flexible spatial orientation of the electrical termination means to the socket member in this simplified manner, there is avoided any necessity for welding or soldering of interconnection elements in the assembly of the lamp circuit. A simple jumper wire or the inleads of a semiconductor diode can provide such interconnection when simply pressed into the appropriate slot openings of the illustrated socket member.

Socket member 58 still further includes, located at each corner, planar surfaces 104, 105, 106 and 107 formed in the otherwise generally cylindrical shaped plastic body to physically lock the socket member in place during the assembly process. Specifically, these four locking surfaces engage one major surface of the panel while the remaining major surface of said panel is being gripped by relief portion 70 in each of the resilient fingers. As one illustration how such an assembly can be benefited from these locking surfaces on the modified socket member, present pinball machine devices commonly utilize a design for multiple mounting of lights in line to provide sequential lighting effects. This is accomplished by the use of a metal panel strip to which the lamp and socket subassemblies are fastened by rivets. This method is labor intensive and in some instances requires additional hard wire and solder joints. In the automatic assembly of a plurality of the improved socket design to a metal planel strip having openings which accommodate socket insertion, there would only be required an insertion of each socket into a particular opening in the strip for locking engagement therewith. It is still further contemplated that automatic assembly of the final lamp circuit configuration using the present socket design can also prewire all lamp and socket assemblies in a harness arrangement and thereafter mount the individual subassemblies on the installation panel to complete the final assembly.

In FIG. 3 there is depicted a different preferred socket embodiment of the present invention which utilizes a semiconductor diode as an external electrical element having its inlead wires pressed into the slots of the socket member for electrical contact with the internal connector elements. Specifically, said improved socket member 108 includes a pair of electrically conductive metal terminals 110 and 112 which are pressed into slot openings 114 and 116, respectively, located in the base of said plastic body member. Only terminal 112 is in physical contact with one internal connector element (not shown) and with remaining terminal 110 being only electrically connected to the other internal connector element by means of a series connection achieved through an associated semiconductor diode element 118. Said external electrical connection is achieved through physical contact with inlead 120 of the diode and terminal 110 while the other diode inlead 122 is in physical contact with one of the internal connector elements. As can be further noted from said drawing, the larger size openings 124 provided in the slot openings of the illustrated socket embodiment have a tapered bore construction to facilitate high speed automatic insertion of said external electrical element.

It will be apparent from the foregoing description that various modifications may be made in the present improved socket member still within the spirit and scope of the present invention. For example, variations in the electrically conductive metal terminals which can be used are contemplated to accommodate specific mounting needs of a particular installation panel. It is thereby intended to limit the present invention, therefore, only by the scope of the foregoing claims.

What we claim as new and desire to secure by United States Letters Patent is:

1. In a lamp socket for a wedge base incandescent lamp comprising a cylindrical shape plastic body member with a hollow cavity opening at one end into which the lamp is inserted for frictional engagement with a pair of connector elements located at the bottom of said hollow cavity, a first and second pair of slots located in opposing relationship at the other end of said plastic body member, only said first pair of slots communicating with said connector elements but with said second pair of slots being electrically connected to said connector elements with external electrical elements, and electrically conductive metal terminals which are pressed into the slots for electrical contact with said connector elements, the improvements which further include a pair of opposing resilient fingers being integrally formed in the open end of the plastic body member to physically engage external lamp support means and larger size openings at one end of each slot to accommodate external electrical elements frictionally engaged in said larger size openings for electrical contact with the connector elements.

2. A lamp socket as in claim 1 wherein the larger size openings in the slots are tapered.

3. A lamp socket as in claim 1 wherein the electrically conductive metal terminals are strips having the unconnected ends further include insulation piercing elements.

* * * * *